US006183657B1

(12) United States Patent
Saito et al.

(10) Patent No.: US 6,183,657 B1
(45) Date of Patent: Feb. 6, 2001

(54) CORE MATERIAL FOR NOISE FILTER

(75) Inventors: Akihiko Saito, Nagoya; Michiharu Ogawa, Inabe-gun; Kazuhisa Tsutsui, Toukai; Shinichiro Yahagi, Oobu, all of (JP)

(73) Assignee: Daido Tokushuko Kabushiki Kaisha, Nagoya (JP)

( * ) Notice: Under 35 U.S.C. 154(b), the term of this patent shall be extended for 0 days.

(21) Appl. No.: 09/313,206

(22) Filed: May 18, 1999

(30) Foreign Application Priority Data

May 18, 1998 (JP) ..... 10-135359
Feb. 16, 1999 (JP) ..... 10-036781

(51) Int. Cl.[7] ..... H01R 17/04
(52) U.S. Cl. ..... 252/62.53; 252/62.55; 252/62.54; 148/104
(58) Field of Search ..... 148/104; 252/62.55, 252/62.53, 62.54

(56) References Cited

FOREIGN PATENT DOCUMENTS

33035 * 8/1990 (EP) .
0 383 035 8/1990 (EP) .
59-119801 * 7/1984 (JP) .
61-198708 9/1986 (JP) .
2-97646 * 4/1990 (JP) .
04358003 12/1992 (JP) .
10-12442A 1/1998 (JP) .
10083910 3/1998 (JP) .
10-261516A 9/1998 (JP) .
11074140 3/1999 (JP) .

OTHER PUBLICATIONS

Abstract for JP4–358,003, dated Dec. 11, 1992.*

Abstract for 61–198,708, dated Sep. 3, 1986.*

Abstract for JP 11–741,140, dated Mar. 16, 1999.*

* cited by examiner

*Primary Examiner*—C. Melissa Koslow
(74) *Attorney, Agent, or Firm*—Bacon & Thomas

(57) ABSTRACT

In a core material for the noise filter, powders of a flat and soft magnetic material is dispersed and buried into an insulating material such as rubber or plastic.

6 Claims, 3 Drawing Sheets

CORE MATERIAL FOR NOISE FILTER

BACKGROUND OF THE INVENTION

1. Field of the Invention

The present invention relates to a core material for a noise filter, and in particular to a core material suitable to high frequency more than 200 MHz.

2. Description of the Related Art

A noise filter using a magnetic material for a core has utilized a noise controlling effect due to magnetic loss of the magnetic material of the core. For the noise filter using such magnetic material, since impedance(Z) and resistance (R) are required to be large, the core material for the noise filter should have large relative magnetic permeability and magnetic loss.

Conventionally, the noise filter using the magnetic material as the core has used a ferrite as the core material.

The noise filter using the ferrite as the core sufficiently functions as the noise filter for low frequency. However, if it is used in a domain of high frequency, a number of coils must be increased. Further, when the coil number is increased, many coils are close together and floating capacitance occurred inconveniently. Further, in an area of high frequency as 100 MHz or more, such filters cannot be used.

Unexamined Japanese Patent Publication (kokai) No. Hei 10-12442 discloses a core material for a noise filter available in wide zones as high frequency of 100 MHz or more. In the core material, two or more magnetic layers different in thickness are laminated via an insulating layer on a surface of a thin sheet of magnetic material such as permalloy.

However, this core material had defects that since the core material is produced by forming thin layers of an insulating layer and a magnetic layer through a spattering process on a thin sheet of magnetic material made of such as permalloy. Accordingly, each of processes take much time, number of the processes are many, and costs for materials are expensive.

SUMMARY OF THE INVENTION

It is an object of the present invention to provide such a core material for a noise filter which has high properties, namely, high damping factor even in high frequency and is low in manufacturing costs.

According to the present invention, the core for the noise filter comprises an insulating material such as a rubber, a plastic or the like, and flat and soft magnetic material powders composed of Cr: 0.5 to 20%, Si: 0.001 to 3.0%, Al: 0.01 to 20% and the balance being Fe and unavoidable impurities, said powders being dispersed and buried in said insulating material.

By the above mentioned composition, the core material for the common mode noise filter of the present invention has excellent effects that it is high in the damping effect in the high frequency, and may be manufactured at economical costs.

DETAILED DESCRIPTION OF THE INVENTION

A core material for noise filter according to the present invention will be explained in detail.

Powders of soft magnetic material of the core material for the noise filter according to the present invention may be powders of known soft magnetic material such as pure iron, permalloy, molybdenum permalloy, Sendust alloy, soft magnetic amorphous alloy powders. Particularly, an alloy composed of Cr: 0.5 to 20%, Si: 0.001 to 3.0%, Al: 0.01 to 20% and the balance being Fe and unavoidable impurities (Unexamined Japanese Patent Publication (kokai) No. 10-261516) is preferable since it has high permeability, excellent corrosion resistance, easy flatness and small coercive force (Hc).

This soft magnetic material powder is that the larger is the aspect ratio, the smaller is the antimagnetic field coefficient, and the aspect ratio is not less than 10, more preferable not less than 25, and the average diameter is 100 $\mu$m or less, the average breadth is 60 $\mu$m or less and the average thickness is 3 $\mu$m or less.

In addition, as the rubber or plastic of the insulating material for the core material for the noise filter, may be employed natural rubber, synthetic rubber as chloroprene rubber, polybutadiene rubber, polyisoprene rubber, ethylene propylene rubber, acrylonitrile butadiene rubber, isobutylene isoprene rubber, styrene butadiene rubber, soft or hard plastics as phenol resin, epoxy resin, polyester resin, acrylic resin, polyvinyl acetate resin, polystyrene resin, polypropylene resin, polyurethane and polycarbonate resin, or poly ethylene chlorate.

The mixing ratio of the soft magnetic material powder and the insulating material is not limited to the above mentioned, but the soft magnetic material powder is 50 vol % or more, 70 wt % or more, e.g., 80 wt %, and the insulating material is 50 vol % or less, 30 wt % or less, e.g., 20 wt % or less.

Figure 1:
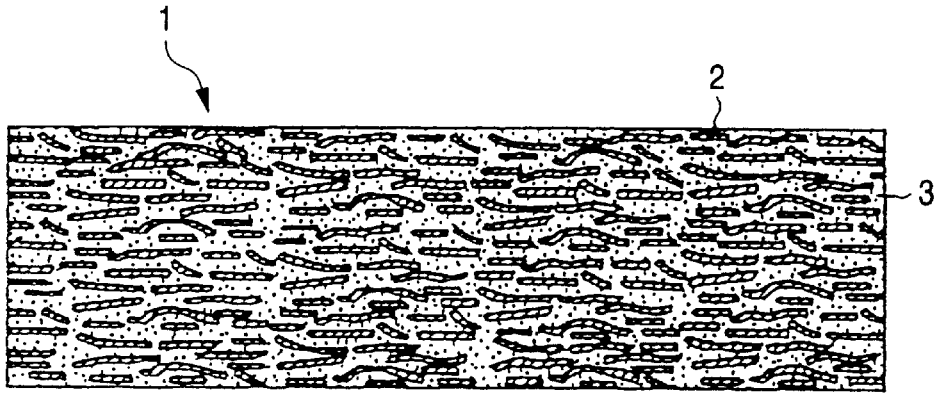
FIG. 1 is a cross sectional view showing schematically sheet for the core material for noise filter.

The core material according to the present invention is produced in the following manner. Namely, the powders of the soft magnetic material (e.g., flat) and the insulating material are mixed uniformly by means of such as a mixing roller. Then, after molding such as a roll molding, an extrusion molding and an injection molding, it is molded by a molding method by which residual strain does not remain in the powders of the soft magnetic material so as to be molded in the cross section as shown in FIG. 1. As shown in FIG. 1, 1 is the core material, 2 is the flat and soft magnetic material, and 3 is the insulating material. If necessary, it is cut in a desirable size. Incidentally, so-called pressed powder magnetic core produced by a press powder molding method such as pressing has residual strain. Accordingly, it is not preferable as the producing method in the present invention.

EXAMPLES

A further reference will be made to Examples of the present invention.

Example 1

An alloy composed of Cr: 7%, Si: 1%, Al: 8% and the balance being Fe was melted, and powders of 10 μm in average diameter were produced by a water spray. The powders were contained in an attriter to make an aspect ratio 20, and those flake powders were subjected to an annealing treatment in an inert gas atmosphere at a temperature of 800° C. for 120 minutes. Those powders (the average diameter was 10 μm, the average breadth was 1 μm and the average thickness was 1 μm, and the aspect ration was 20) were 50 vol % uniformly dispersed into the polyethylene chlorate of 50 vol %. Then the sheet of the core material for the noise filter of 0.25 mm thickness, 150 mm width and 200 mm length was produced by the roll molding as shown in FIG. 1.

Figure 2:
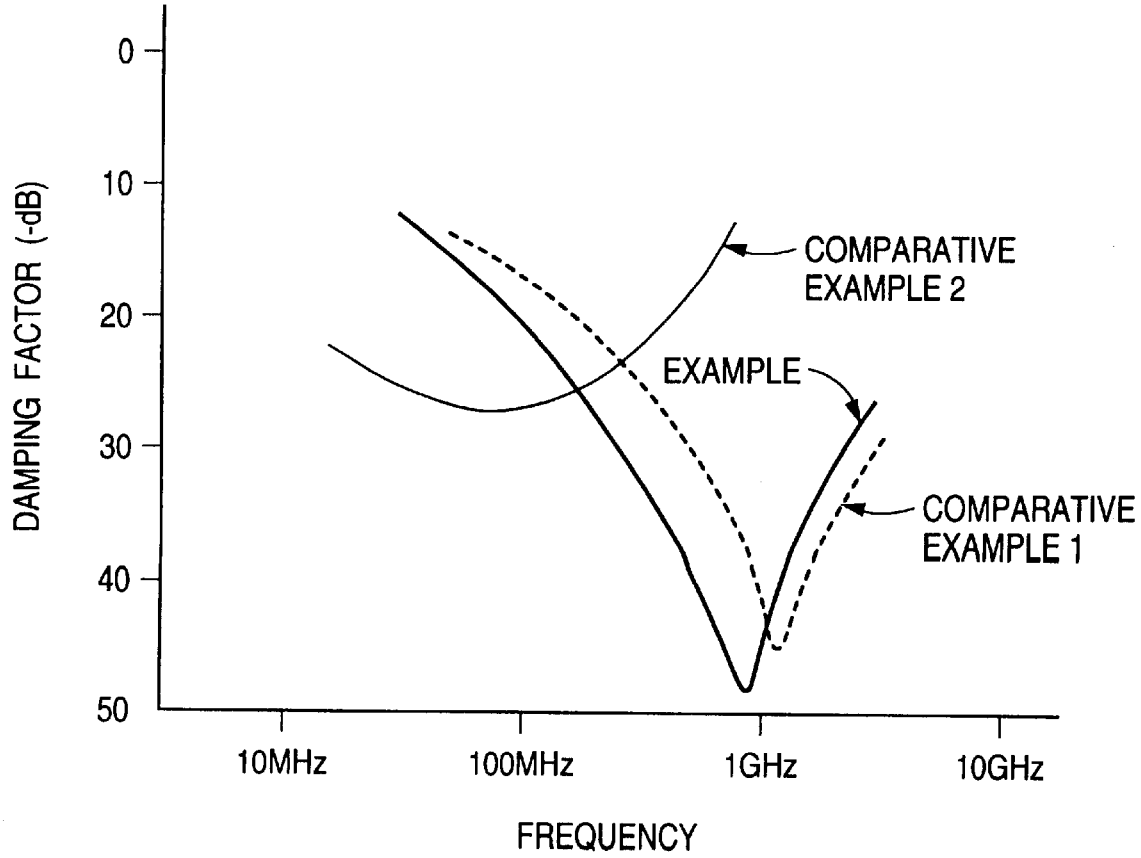
FIG. 2 is a graph showing the relation between the frequency and the damping factor of the common mode noise filters made of the Example and the Comparative Examples.

From this sheet, the core for the noise filter of 0.25 mm thickness, 1 mm width and 12 mm length was made, and coiled to make a common mode noise filter. The damping factor in each frequency of this common mode noise filter was measured. The result is shown in FIG. 2.

The measuring manner of the damping factor in each frequency was made by measuring $S_{21}$ through a network analyzer.

The sheet of the core material for the noise filter as a Comparative Example 1 was manufactured by providing the magnetic layer of the thin film having thickness 5 μm composed of 78 wt % Ni—Fe permalloy on one side of a strip of the magnetic material having thickness 5 μm composed of 78 wt % Ni—Fe permalloy via the insulating layer having thickness 5 μm of $SiO_2$, and further providing 10 layers of the magnetic material having thickness 5 μm composed of 78 wt % Ni—Fe permalloy via the insulating layer having thickness 5 μm of $SiO_2$. From this sheet, the core for the common mode noise filter of 1 mm width and 12 mm length was made, and coiled (14 turns) to make a common mode noise filter. The damping factor in each frequency of this common mode noise filter was measured and described in FIG. 2.

The core for the noise filter as a Comparative Example 2 made of ferrite having 0.25 mm thickness, 1 mm width and 12 mm length was manufactured. This core was coiled (14 turns) to make the common mode noise filter. The damping factor in each frequency of this common mode noise filter was measured and the result is shown in FIG. 2.

Example 2

An alloy composed of Cr: 7%, Si: 1%, Al: 8% and the balance being Fe was melted, and powders of 10 μm in average diameter were produced by a water spray. The powders were contained in an attriter to make an aspect ratio 20, and those flake powders were subjected to an annealing treatment in an inert gas atmosphere at a temperature of 800° C. for 120 minutes. Those powders (the average diameter was 10 μm, the average breadth was 1 μm and the average thickness was 1 μm, and the aspect ration was 20) were 50 vol % uniformly dispersed into the polyethylene chlorate of 50 vol %. Then the sheet of the core material for the noise filter of 0.25 mm thickness, 150 mm width and 200 mm length was produced by the roll molding as shown in FIG. 1.

Figure 3:
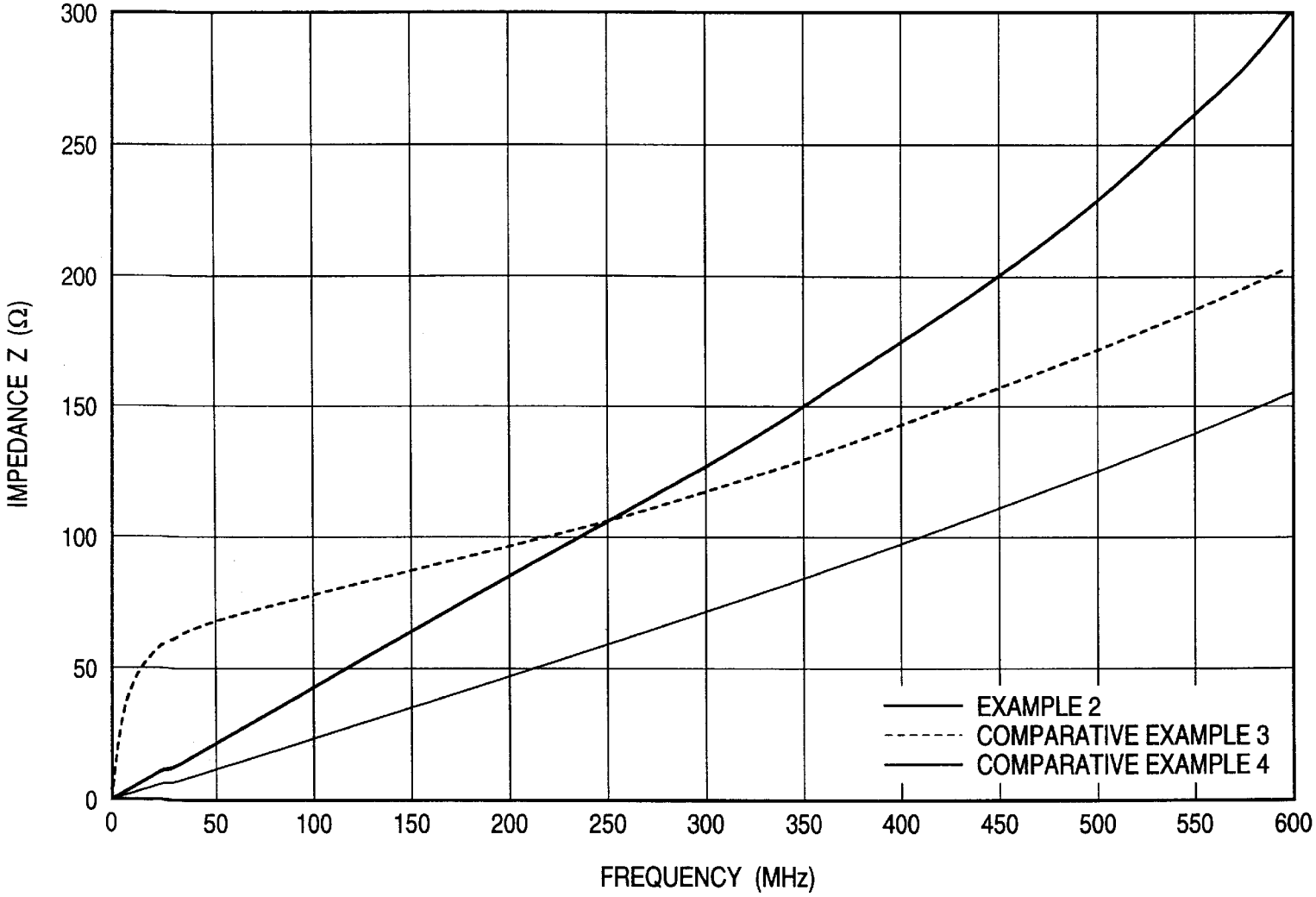
FIG. 3 is a graph showing the relation between the frequency and the impedance of the core material for the noise filter using the flat soft magnetic material powder of the Example and the core material for noise filter of Comparative Examples.

From this sheet, the core for the noise filter of 0.25 mm thickness, 1 mm width and 12 mm length was made, and impedance was measured at each frequency. The result is shown in FIG. 3.

Incidentally, for measuring impedance at each frequency, an impedance analyzer HP4291B was used, and a Cu cable having a diameter of 0.5 mm was used. The number of turns was 1.

Figure 4:
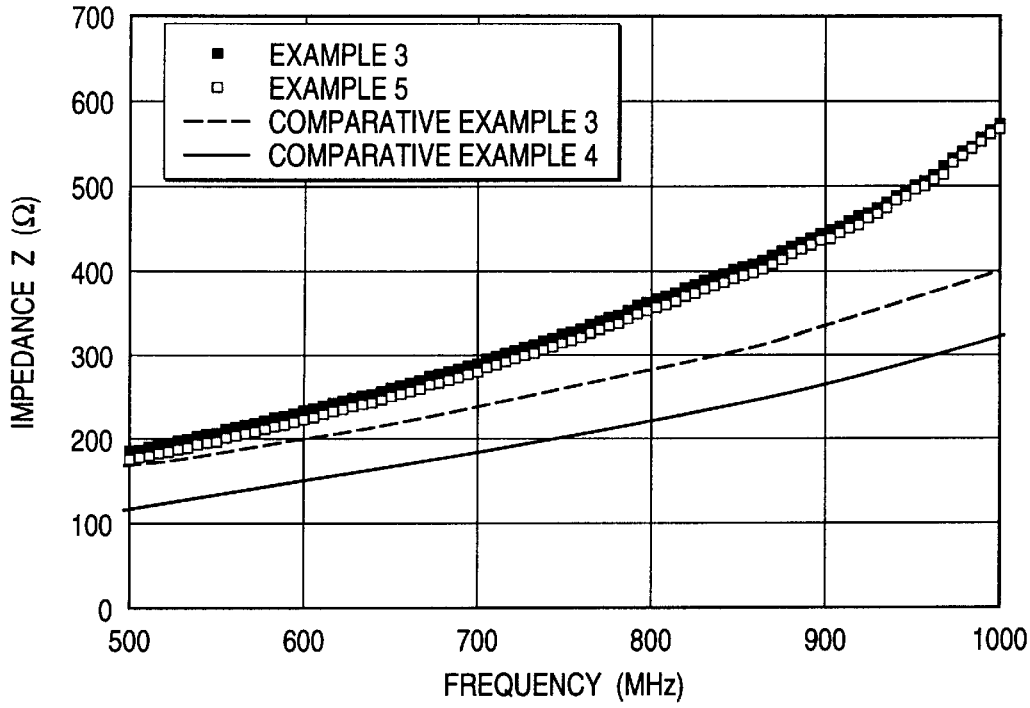
FIG. 4 is a graph showing the relation between the frequency and the impedance of the core material for the noise filter using the flat soft magnetic material powder of the Example, the core material for the noise filter using the non-flat soft magnetic material powder of the Example, and the core material for the noise filter of the Comparative Examples.
Figure 5:
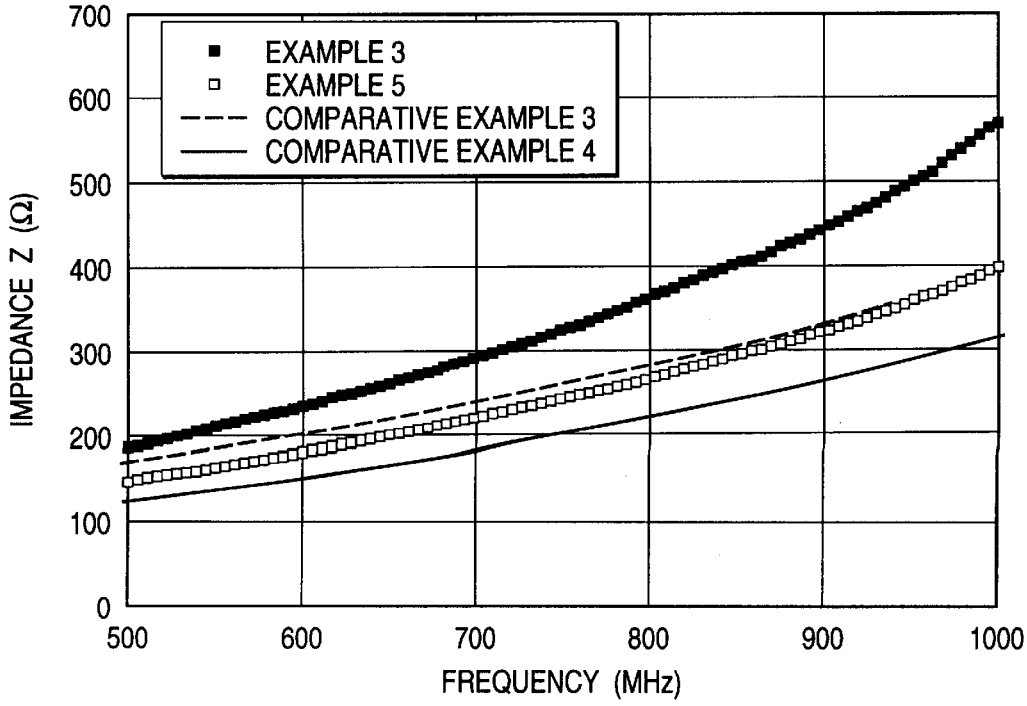
FIG. 5 is a graph showing the relation between the frequency and the impedance of the core material for the noise filter using the soft magnetic material powder of the Example having small average diameter, the core material for the noise filter using the soft magnetic material powder of the Example having large average diameter, and the core material for the noise filter of the Comparative Examples

As a Comparative Example 3, the core for the noise filter described in a Comparative Example 2 made of ferrite having 0.25 mm thickness, 1 mm width and 12 mm length was manufactured. Then, its impedance was measured at each frequency, and the results are shown in FIGS. 3, 4 and 5.

As a Comparative Example 4, a non-core coil made of Cu wire having the diameter of 0.5 mm was used. Its impedance was measured at each frequency as similar to the manner in Example 2. The results are shown in FIGS. 3, 4 and 5.

Example 3

An alloy composed of Cr: 7%, Al: 9% and the balance being Fe was melted, and powders of 18 μm in average diameter were produced by a water spray. A compound was produced by mixing the powder, nylon 12 and silane coupling agent A1100 so that the amount of the powder became 89 wt %. The compound was injection-molded to produce the core material for the noise filter having the outer diameter 12 mm, the inner diameter of 8.5 mm and the length of 16 mm.

By using this core material for the noise filter, its impedance at each frequency was measured. The results are shown in FIGS. 3, 4 and 5.

Example 4

The powders in Example 3 were contained in an attriter to make an aspect ratio 20, and those flake powders were subjected to an annealing treatment in an inert gas atmosphere at a temperature of 800° C. for 120 minutes. Those powders (the average diameter was 10 μm, the average breadth was 1 μm and the average thickness was 1 μm, and the aspect ration was 20), nylon 12 and silane coupling agent A1100 were mixed to produce a compound in which the amount of the powder was 85 wt %. The compound was injection-molded to produce the core material for the noise filter having the outer diameter of 12 mm, the inner diameter of 8.5 mm and the length of 16 mm.

By using this core material for the noise filter, its impedance was measured at each frequency. The result is shown in FIG. 4.

Example 5

An alloy composed of Cr: 7%, Al: 9% and the balance being Fe was melted, and powders of 70 μm in average diameter were produced by a water spray. A compound was produced by mixing the powder, nylon 12 and silane coupling agent A1100 so that the amount of the powder became 89 wt %. The compound was injection-molded to produce the core material for the noise filter having the outer diameter 12 mm, the inner diameter of 8.5 mm and the length of 16 mm.

By using this core material for the noise filter, its impedance at each frequency was measured as similar to Example 2. The result is shown in FIG. 5.

It is seen from these results that the common mode noise filter according to the present invention shows the high damping factor up to 1 GHz as the common mode noise filter of the Comparative Example 1 using Ni—Fe permalloy. In contrast, the common mode noise filter of the Comparative Example 2 using ferrite shows that the damping factor is lowered at the higher frequency than 200 MHz.

Further, as shown in FIG. 3, the impedance of the core material for the noise filter according to the present invention is higher than that of the Comparative Example 4 at any frequencies. The impedance of the core material for the noise filter according to the present invention is higher than that of the Comparative Example 3 using ferrite at the frequency at over 250 MHz.

As shown in FIG. 4, the addition amount of the core material for the noise filter of Example 4 using the flat soft magnetic powders is 4% lower than that of the core material for the noise filter of Example 3 using the no-flat soft magnetic powders. Namely, it is possible to reduce the addition amount of the soft magnetic powders by using the flat soft magnetic powders.

As shown in FIG. 5, the impedance of the core material for the noise filter of Example 3 using the soft magnetic powder having small average diameter is higher than that of the core material for the noise filter of Example 5 using the soft magnetic powder having large average diameter.

A cost of the inventive common mode noise filter is around 1/1000 of that of the common mode noise filter of the Comparative Example 1, and around ½ of the Comparative Example 2.

What is claimed is:

1. A core material for a noise filter comprising: powders of soft magnetic material and an insulating material, said powders being dispersed and buried in said insulating material, wherein the powders of said soft magnetic material is composed of Cr: 0.5 to 20 wt %, Si: 0.001 to 1.0 wt %, Al: 0.01 to 20 wt % and the balance being Fe and unavoidable impurities.

2. The core material for the noise filter according to claim 1, wherein the powers of soft magnetic material is flat powders said soft magnetic material.

3. The core material for noise filter according to claim 1, wherein said insulating material is a rubber or a plastic.

4. The core material for noise filter according to claim 3, wherein the powders of said soft magnetic material has an aspect ratio not less than 10.

5. The core material for noise filter according to claim 4, wherein the powders of said soft magnetic material has an aspect ratio not less than 25.

6. The core material for noise filter according to claim 1, wherein the powders of said soft magnetic material has an average diameter is 100 $\mu$m or less, an average breadth is 60 $\mu$m or less and an average thickness is 3 $\mu$m or less.

* * * * *